US007757733B2

(12) United States Patent
Liao

(10) Patent No.: US 7,757,733 B2
(45) Date of Patent: Jul. 20, 2010

(54) PLANER WITH CARRIAGE LOCKING MECHANISM

(76) Inventor: Chih Hung Liao, No. 396 Yong Ming Street, Ta Li City, Taichung (TW)

( * ) Notice: Subject to any disclaimer, the term of this patent is extended or adjusted under 35 U.S.C. 154(b) by 143 days.

(21) Appl. No.: 12/009,361

(22) Filed: Jan. 18, 2008

(65) Prior Publication Data

US 2009/0183799 A1 Jul. 23, 2009

(51) Int. Cl.
*B27C 1/00* (2006.01)

(52) U.S. Cl. ..... 144/117.1; 409/209; 409/218

(58) Field of Classification Search ..... 144/114.1, 144/117.1, 129, 130; 409/206, 209, 210, 409/218

See application file for complete search history.

(56) References Cited

U.S. PATENT DOCUMENTS 5,771,949 A 6/1998 Welsh et al.
5,794,675 A 8/1998 Garcia
5,957,173 A * 9/1999 Garcia ..... 144/117.1
6,085,812 A * 7/2000 Chiang ..... 144/117.1
6,283,179 B1 * 9/2001 Liao ..... 144/130
6,394,155 B1 * 5/2002 Wang ..... 144/130
6,516,684 B1 * 2/2003 Chang ..... 74/579 R
6,585,017 B1 7/2003 Campbell et al.

* cited by examiner

*Primary Examiner*—Shelley Self
(74) *Attorney, Agent, or Firm*—Greer, Burns & Crain, Ltd.

(57) ABSTRACT

A locking mechanism for a thickness planer having a base and a carriage with a cutting head. The carriage is mounted to a plurality of support columns movably attached to the base. The locking mechanism includes a first lock plate associated with the base and positioned adjacent to a first pair of the support columns and a second lock plate associated with the base and positioned adjacent to a second different pair of the support columns. An actuator is coupled to the first lock plate and the second lock plate and is configured for causing the first lock plate to engage the first pair of the support columns and the second lock plate to engage the second pair of the support columns to exert a clamping force by moving the first and second lock plates towards each other to firmly secure the carriage in position.

15 Claims, 8 Drawing Sheets

107
104
105
150
152
148
171
132
140
146
134
170
168
166
180
177
176
182
178
174
172
164
156
190
192
144
142
188
154
158
160
200

104
138
108
166
176
182
186
10A
171
238b
185
238a 184
170
168
180
177
178
156
164
190
152
192
148
144
140
142
188
150
154
146
158
160

PLANER WITH CARRIAGE LOCKING MECHANISM

BACKGROUND OF THE INVENTION

The invention relates to a thickness planer and more specifically, to a thickness planer having a carriage locking mechanism that reduces vibration and movement of the carriage during a planing operation.

Planing is the removal of wood from a surface or face of a board so as to make it flat, uniform, and smooth. In woodworking, planing is a common operation that is used in manufacturing cabinets, tables and other wood products.

Conventional thickness planers include a base having four perpendicularly mounted columns. A carriage is supported on the support columns and includes a rotating cutting head. The cutting head has at least one cutting knife which, when rotated, removes a designated amount of material from a workpiece passing through the planer.

Most thickness planers include a lead screw for adjusting the height or distance of the carriage above the base. Since the cutting head is rotatably attached to the carriage, the height of the carriage determines the amount of material that is removed from the workpiece and thereby the thickness of the workpiece exiting the planer. The difference between the thickness of the workpiece entering the planer and the thickness of the workpiece exiting the planer is known as the depth of cut, which is the depth of the material that is removed by one pass of the workpiece through the thickness planer. To facilitate the movement of the workpiece through the planer, a motor-powered infeed roller pulls the workpiece into the planer, while an outfeed roller helps the workpiece to exit the planer. Conventional thickness planers also typically include an infeed shelf or table and an outfeed table that supports the workpiece as it is being fed and cut.

To provide versatility, the carriage is typically adjustable to different heights. However, during the cutting operation, it is preferred that the carriage be securely attached to the housing of the thickness planer. Otherwise, vibration and movement of the carriage during the planing operation may produce undesired "snipe" or localized variations in the workpiece thickness. This undesired vibration and movement is especially prevalent when the workpiece is entering or exiting the thickness planer, i.e. at the beginning and end of a cut. Accordingly, some conventional thickness planers include locks, which secure the carriage in position during operation.

There are different types of carriage locks. For example, U.S. Pat. No. 5,794,675 to Garcia discloses a carriage lock containing forks running the length of the support columns. The forks are deflected and sandwiched between the carriage and associated support columns to frictionally secure the carriage. Garcia, however, attempts to lock the carriage in line with the cutting head instead of locking the carriage at a location away from the cutting head. It has been found that the close proximity of the locking mechanism to the cutting head likely reduces stability when locking the carriage.

Another type of carriage lock is disclosed in U.S. Pat. No. 5,771,949 to Welsh et al. Welsh discloses various resiliently deflectable mechanisms having springs, levers, or more resiliently deflectable members to secure the carriage at a given height.

Existing carriage locks such as those described above, however, fail to produce a mechanical clamping action that reduces the amount of force necessary to lock the carriage, compared to the holding strength of the locks. Further, because existing carriage locks rely upon resiliently deflected members, these mechanisms fatigue over time and become less effective at securing the carriage.

Accordingly, there is a need for an improved carriage lock mechanism that overcomes the drawbacks of conventional units and reduces the amount of snipe in a workpiece by more securely holding the cutting head and the carriage in a desired position.

BRIEF SUMMARY OF THE INVENTION

The above-listed needs are met or exceeded by the present planer including an improved carriage locking mechanism. Opposing movable lock plates are associated with a base of the planer and are moved toward each other to firmly engage carriage holding support columns to secure the carriage in position during operation. The enhanced stability of the present carriage reduces the movement and vibration of a cutting head on the carriage, as well as the carriage itself, which enhances the performance of the planer.

More specifically, the present invention provides a locking mechanism for use with a thickness planer having a base and a carriage with a cutting head. The carriage being mounted to a plurality of support columns that are movably attached to the base to allow the carriage to be displaceable from the base at a defined distance. A workpiece passes between a work area on the base and the cutting head on the carriage to remove a layer of the workpiece. The locking mechanism includes a first lock plate associated with the base and positioned adjacent to a first pair of the support columns and a second lock plate associated with the base and positioned adjacent to a second different pair of the support columns. An actuator is coupled to the first lock plate and the second lock plate. The actuator is configured for causing the first lock plate to engage the first pair of the support columns and the second lock plate to engage the second pair of the support columns to exert a clamping force by moving the first and second lock plates towards each other to firmly secure the carriage in position.

DETAILED DESCRIPTION OF THE INVENTION

Figure 1:
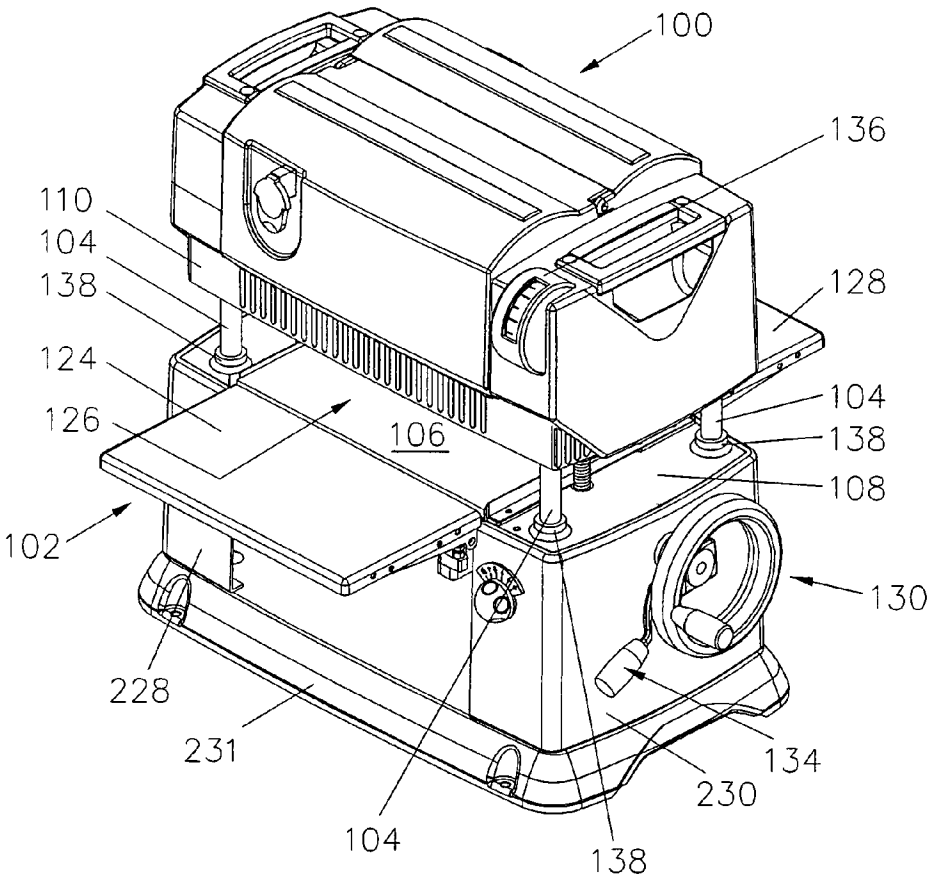
FIG. 1 is a front perspective view of one embodiment of the present thickness planer.
Figure 2:
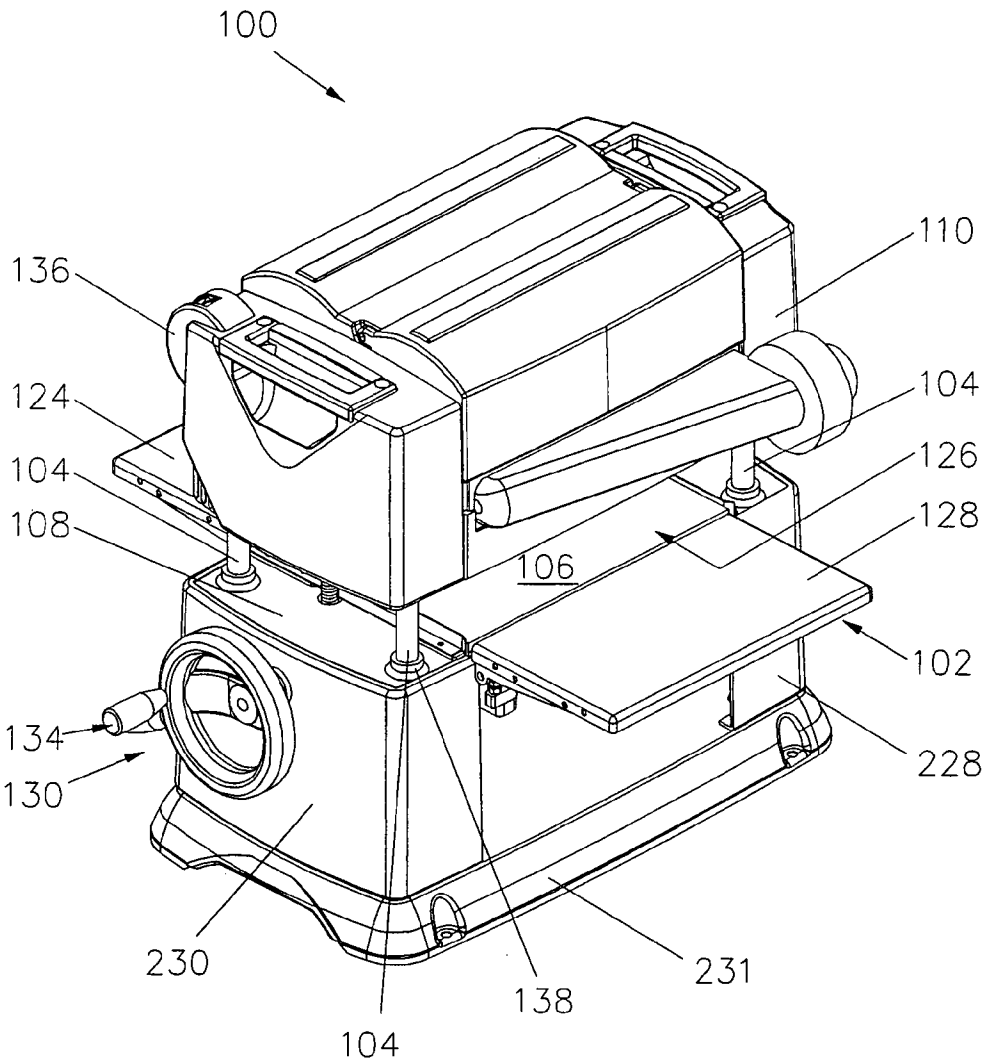
FIG. 2 is a side perspective view of the planer of FIG. 1 showing a first side of the planer.
Figure 3:
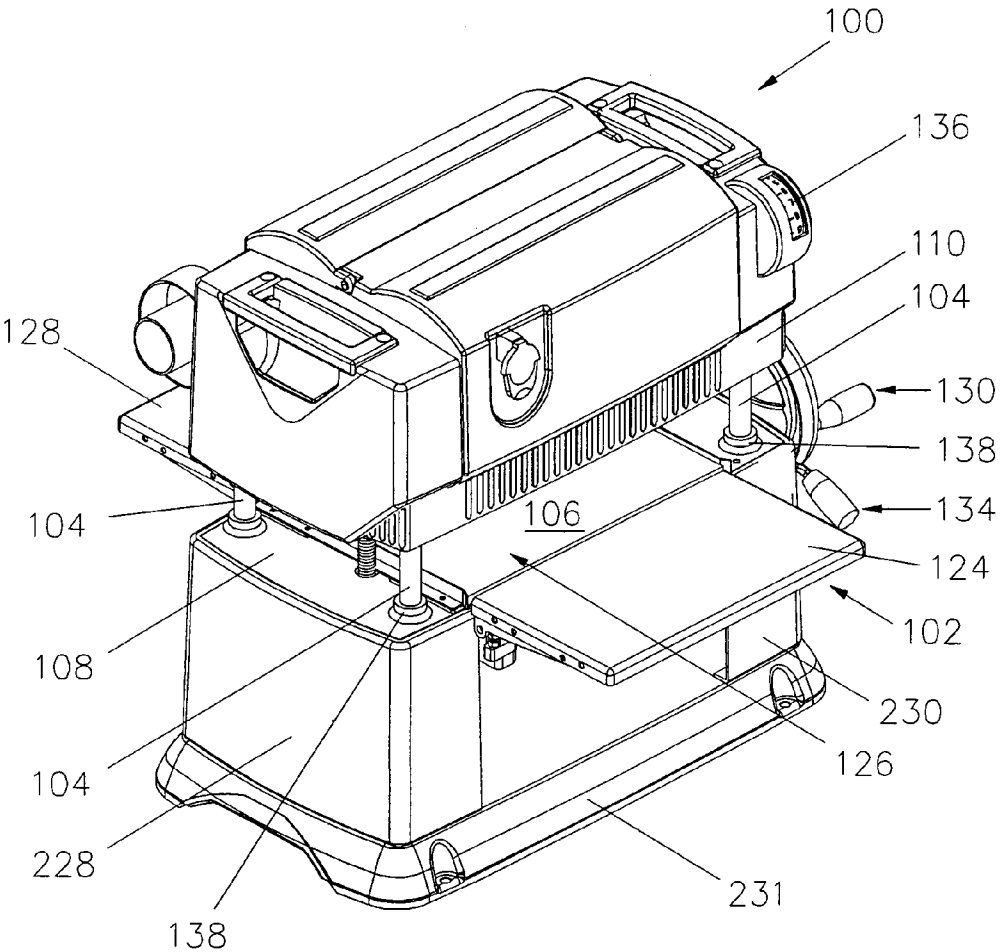
FIG. 3 is a side perspective view of the planer of FIG. 1 showing an opposing second side of the planer.

The invention relates to an apparatus for planing a workpiece to a given thickness such as the thickness planer disclosed by U.S. Pat. No. 6,585,017, the subject matter of which is incorporated herein by reference. The present thickness planer includes a carriage locking mechanism configured for reducing snipe, carriage vibration, and carriage movement by locking the cutting head on the carriage in a secure position. Snipe is a change in the thickness at either end of the planed board caused by an uneven force on the cutting head that most often occurs when a workpiece is entering or leaving the planer. By securely locking the carriage in place, movement and vibration of the carriage are reduced compared to conventional planers.

Referring now to FIGS. 1-4, a thickness planer generally indicated as 100 includes a base 102 and a plurality of support columns 104 that are movably mounted to the base as described in more detail below. The base 102, which is generally the bottom portion or lower portion of the thickness planer 100, includes a work area 106 and perimeter areas 108. A carriage 110 is mounted to four support columns 104 where each of the support columns has a lower bottom end 105 and an upper top end 107. The support columns 104 are inserted through corresponding bores 112. The top or upper ends 107 of each of the support columns 104 are secured to the carriage 110 using a fastener 121 and a washer 123. A motor 114 (FIG. 4), which is used to rotate a cutting head 116 having at least one cutting blade 118, is mounted on the carriage 110. Left and right lead screws 120 and 122 (FIG. 4) are threadably connected to the base 102 and mounted to the carriage 110 by securing the top and side of each of the lead screws to the carriage using a fastener 121, a washer 123, and a side fastener 111. (FIG. 4) Each of the lead screws 120,122 includes a lead gear 131 that is secured to a lower end of the lead screws via a mounting plate 133, a washer 135 and a fastener 137. As described below, the lead gears 131 enable the lead screws 120, 122 to rotate to cause the carriage 110 to move upwardly and downwardly with respect to the base 102.

Thickness planer 100 includes an inlet support shelf 124 upon which a workpiece may be placed for planing. As the workpiece moves through the planer 100, the workpiece is supported by a middle support shelf 126 and an outlet support shelf 128 (shown in FIG. 1). The rotation of a handwheel 130 causes the carriage 110 to move relative to the base 102, thereby accommodating workpieces having different thicknesses and setting different depths of cut.

In the illustrated embodiment, a carriage locking mechanism 132 having an actuator 134 is used to secure the carriage 110 at a given height or distance above the base 102. Also, while a workpiece is being cut, a depth of cut indicator 136 displays the thickness of the material about to be removed from the workpiece by the planer 100.

Figure 4:
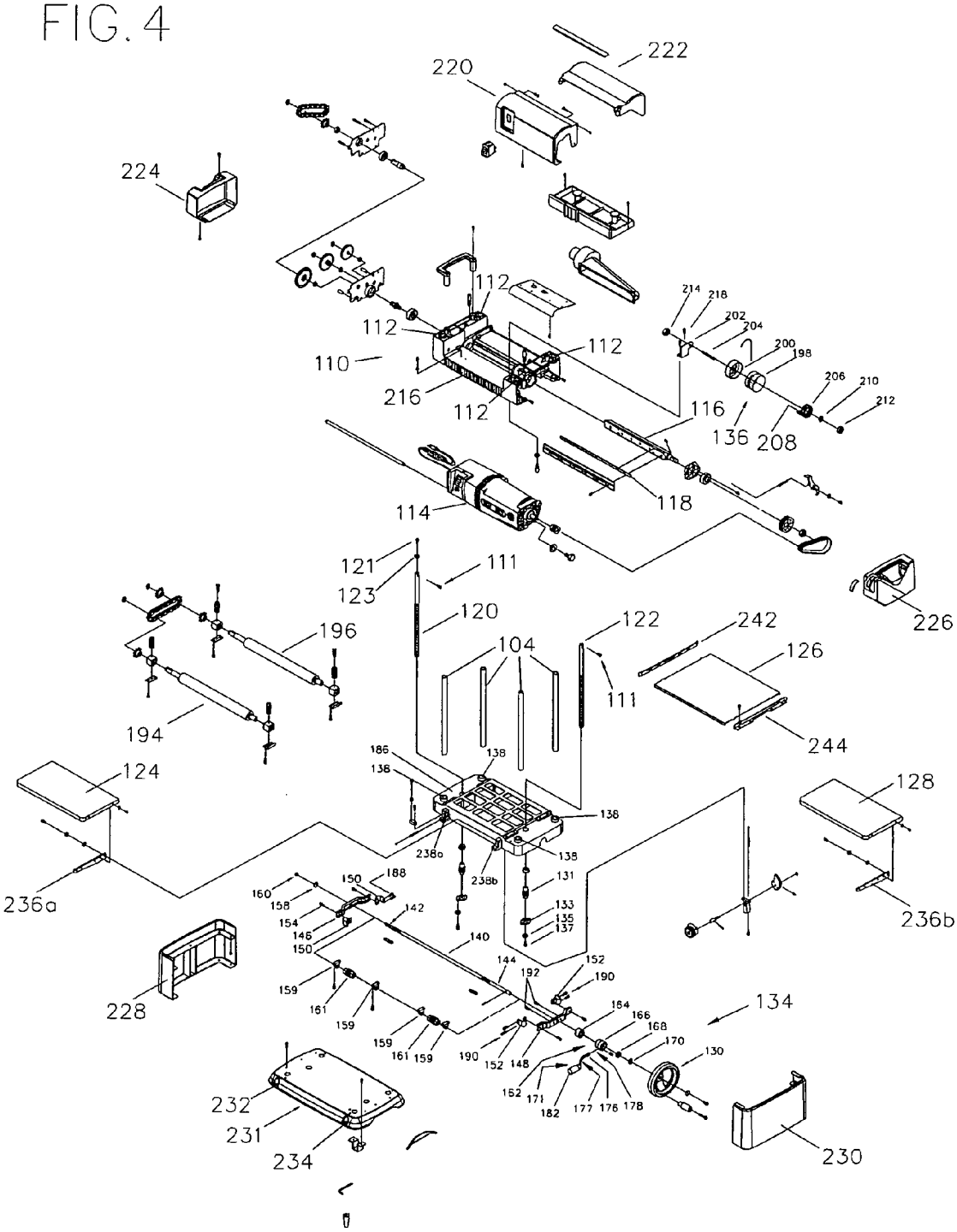
FIG. 4 is a partial exploded perspective view of the planer of FIG. 1.

In a preferred embodiment, four support collars 138 each define an opening or hole located in each of the corners of the base 102. The support collars 138 are separate components and are attached to the base 102. In another embodiment, the support collars 138 are integrally formed with the base 102. As shown in FIG. 4, bores 112 are defined at each of the corners of the carriage 110. The lower bottom ends 105 of the support columns 104 are inserted through each of the support collars 138. The support columns 104 and the lead screws 120, 122 move upwardly and downwardly with respect to the base 102 while simultaneously moving the carriage 110. Thus, carriage 110 moves upwardly and downwardly with respect to the base 102 to adjust the distance of the carriage, and more specifically, the cutting head 116, from the base to enable a user to produce workpieces having different thicknesses.

Figures 5, 6A, 6B:
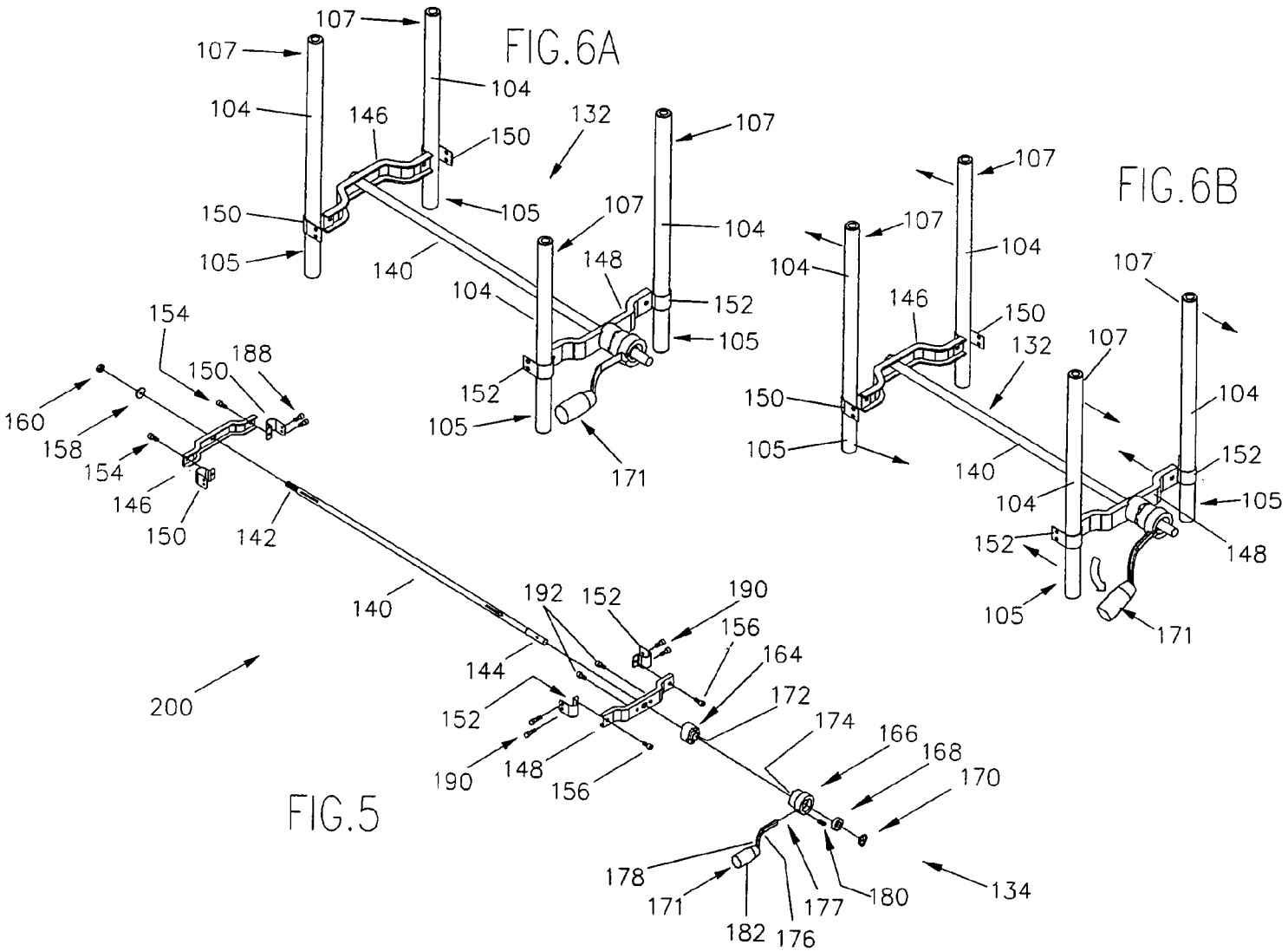
FIG. 5 is an exploded perspective view of one embodiment of the carriage locking mechanism.
FIG. 6A is a perspective view of the carriage locking mechanism of FIG. 5 in an unsecured position relative to the support columns.
FIG. 6B is a perspective view of the carriage locking mechanism of FIG. 5 in a secured position relative to the support columns.
Figures 7, 8:
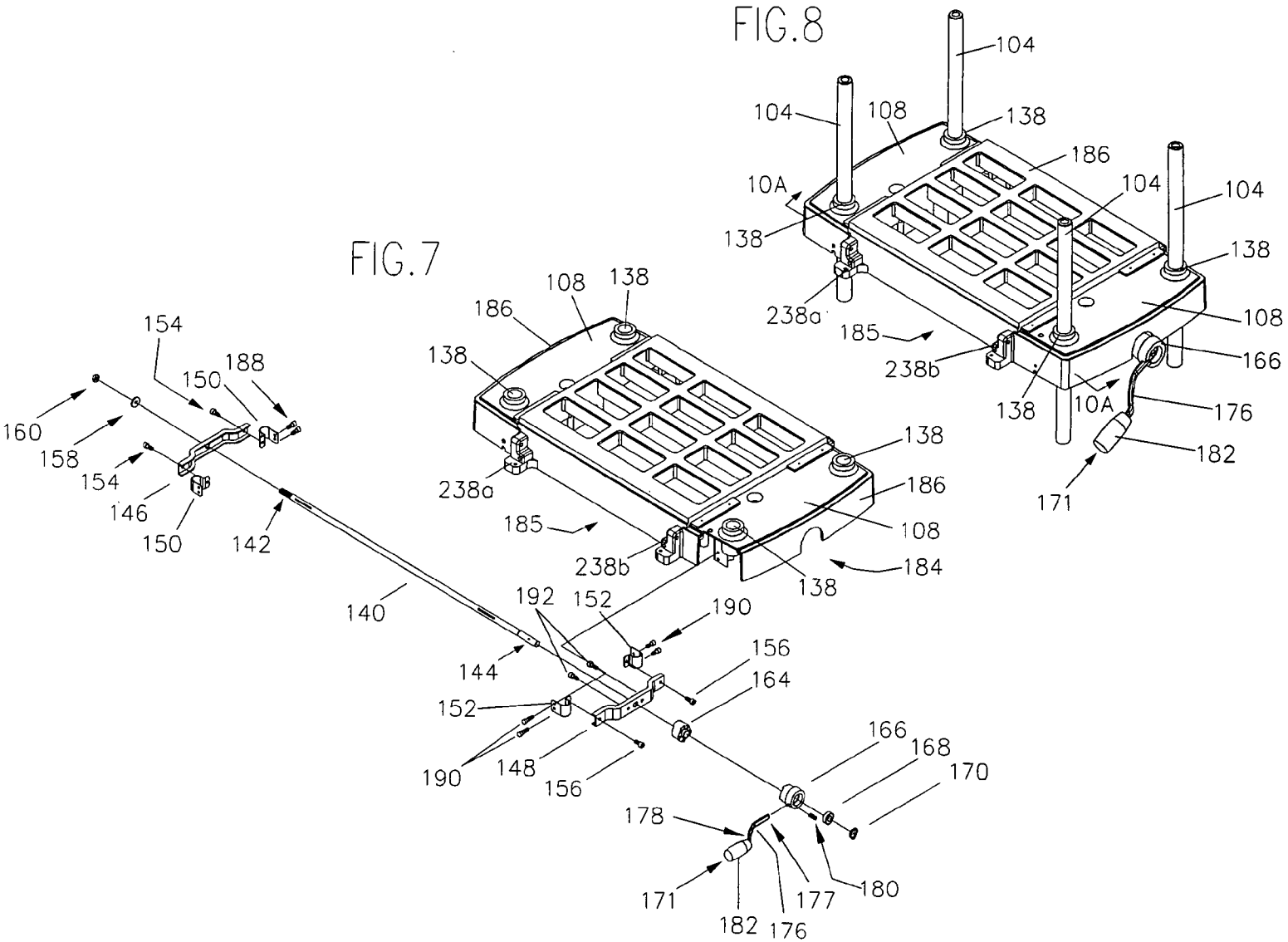
FIG. 7 is an exploded perspective view showing the carriage locking mechanism of FIG. 5 and the base support.
FIG. 8 is a perspective view showing the carriage locking mechanism of FIG. 5 mounted on the base support.
Figure 9:
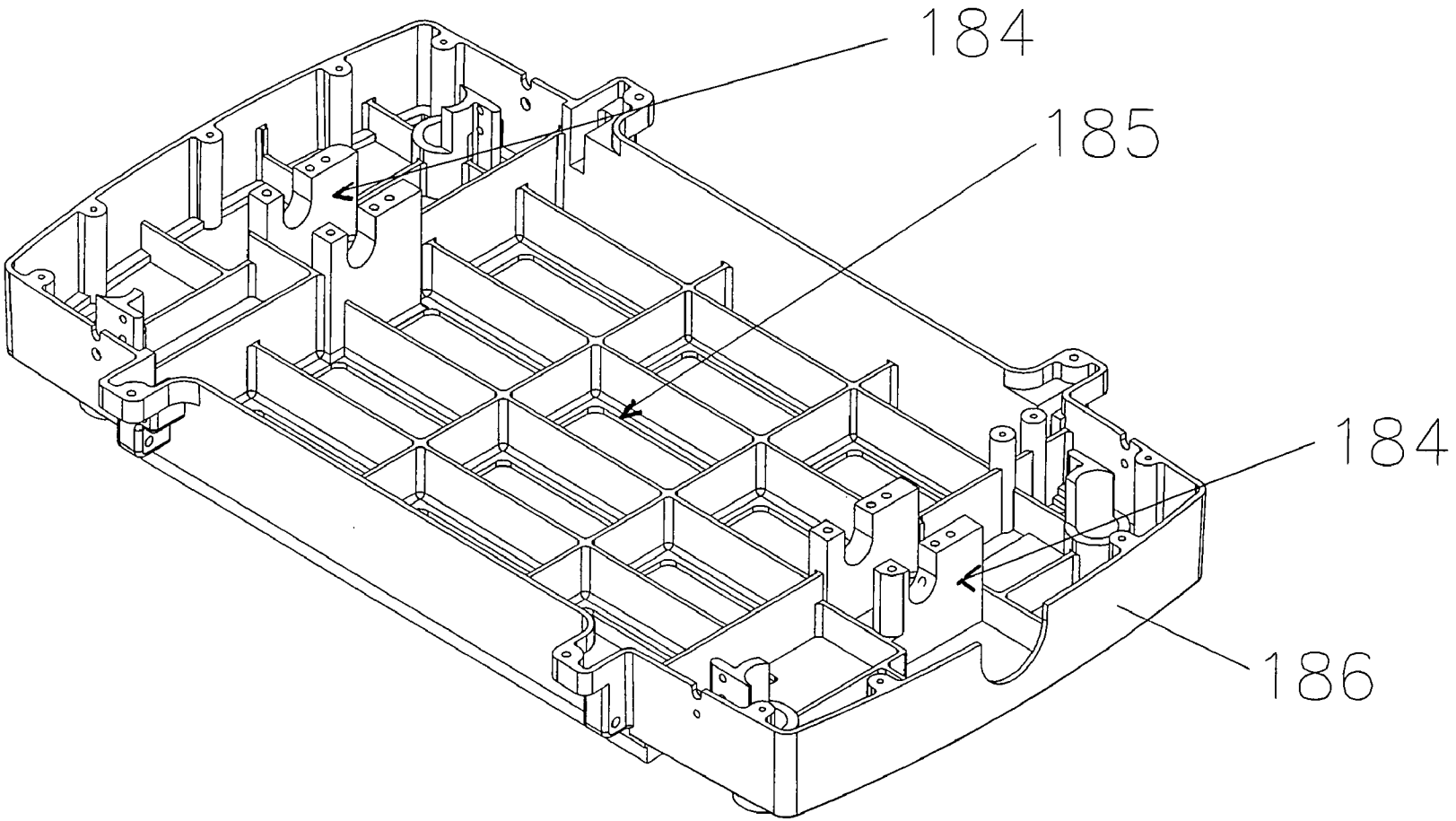
FIG. 9 is an inverted perspective view of the base support.

The carriage locking mechanism 132 helps to secure and lock the carriage 110 in position by applying a tightening or clamping force to the lower portions or bottom ends 105 of the support columns 104. In the illustrated embodiment, the carriage locking mechanism includes a transmission shaft 140 having a first threaded end 142 and a second, opposing non-threaded end 144. Mounted on the first end 142 is a first or left lock plate 146 and on the second end 144 is a second or right lock plate 148. Connected to the left lock plate 146 and the right lock plate 148 are two "U"-shaped brackets 150 and 152, respectively, that are configured to at least partially fit about the support columns 104. As shown in FIGS. 5 and 7, the "U"-shaped brackets 150 and 152 are respectively attached to the first and second lock plates 146, 148 using fasteners 154 and 156. It is also contemplated that the "U"-shaped brackets 150 and 152 may be integrally formed with the first and second lock plates 146 and 148.

Referring now to FIGS. 4-9, the first end 142 of the transmission shaft 140 is inserted through an opening defined by the left lock plate 146 and secured to the left lock plate using a washer 158 and a lock nut 160. The second end 144 of the transmission shaft 140 is inserted through an opening defined by the right lock plate 148. Additionally, the transmission shaft 140 is inserted through a pair of mounting brackets 159 at the first end 142 and the second end 144 where the mounting brackets 159 are secured to the base 102 using suitable fasteners (FIG. 4). A transmission gear 161 is also attached to each end of the transmission shaft 140. As described below, each of the transmission gears 161 mesh with the corresponding lead gears 131 on the left and right lead screws 120,122 to facilitate movement of the lead screws.

In the illustrated embodiment, at least a portion of the second end 144 projects outwardly beyond the right lock plate 148 so that the actuator 134 can be positioned on the second end. Specifically, the actuator 134 includes a cam assembly 162 having a cam 164 defining a central opening through which the cam receives the second end 144 of the transmission shaft 140. The cam assembly 162 also includes a collar 166 that is secured to the second end 144 of the transmission shaft 140 using a washer 168 and a lock ring 170. In the illustrated embodiment, the cam 164 includes a cam surface 172 on at least one end, and the collar 166 includes a complimentary cam surface 174 preferably having at least one projection that engages the cam surface 172 of on the cam 164. Relative rotation of the cam surfaces 172, 174 upon movement of the handle 171 increases the axial spacing between the cam 164 and the collar 166 to exert a clamping or holding force on the right lock plate 148. This force is transmitted through the transmission shaft 140 so that the left and right lock plates 146, 148 are drawn towards each other.

To move or turn the cam assembly 162 and the transmission shaft 140, a handle 171 is attached to the collar 166. The handle 171 includes an arm 176 having a first end 177 and an opposing second end 178. Specifically, the first end 177 of the arm 176 is inserted through an opening defined by the collar 166 as shown in FIG. 5 and is secured to the collar by a set screw 180. A knob 182 is attached to the opposing end 178 of the arm 176.

As shown in FIGS. 7, 9, 10A and 10B, once assembled, the carriage locking mechanism 132 is positioned in corresponding grooves 184 defined by a bottom surface or underside 185 of a base support 186 of the base 102. The base support 186 also includes the perimeter areas 108 and the support collars 138 described above. In the illustrated embodiment, the grooves 184 are formed of a size and shape that allow for axially movement of the left and right lock plates 146, 148 with in the grooves. Specifically, the left and right lock plates 146 and 148 are positioned so that the "U"-shaped brackets 150 and 152 at least partially surround the support columns 104. The carriage locking mechanism 132 is secured to the bottom of the base support 186 by several fasteners 188, 190 and 192 passing through corresponding lock plates 146, 148. When the carriage locking mechanism 132 is in an "unsecured" or "release" position (FIG. 10A), the "U"-shaped brackets 150 and 152 do not contact the support columns 104 with sufficient force to securely lock the carriage 110 in position.

Figure 10A:
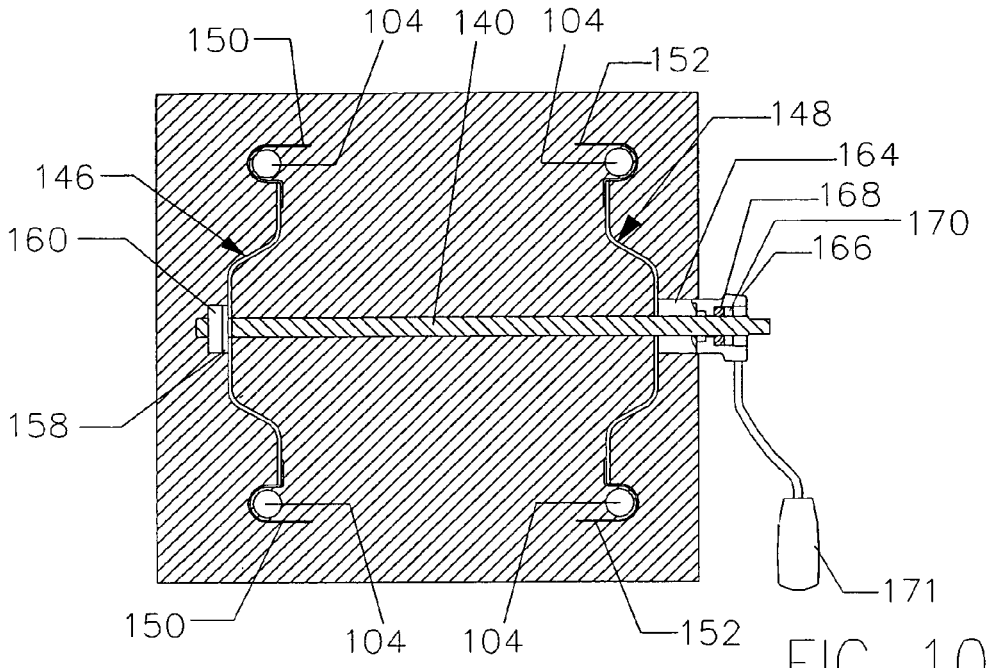
FIG. 10A is a cross-section view taken along lines 10A-10A in FIG. 8 showing the carriage locking mechanism in the unsecured position relative to the support columns.
Figure 10B:
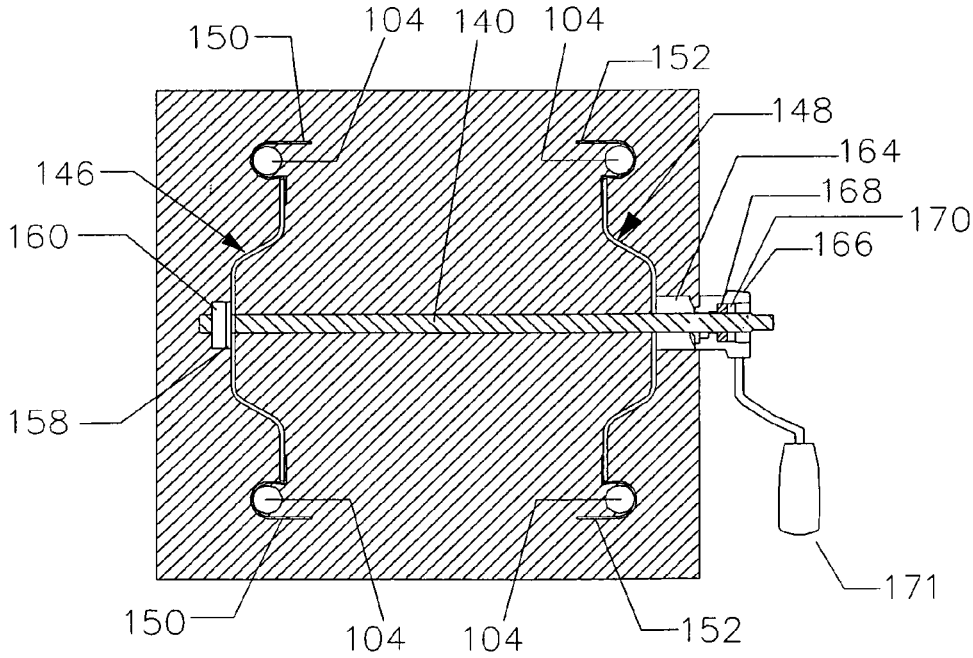
FIG. 10B is a cross-section view similar to FIG. 10A showing the carriage locking mechanism in the secured position relative to the support columns.

To lock the carriage 110 in position at a given elevation or height above the base 102, an operator moves or rotates handle 171 counter-clockwise (i.e., downward) from the "unsecured" or "release" position (FIG. 10A) to a "secured" or "locked" position (FIG. 10B). The rotation of the handle 171 to the "locked" position causes the collar 166 to rotate relative to the cam 164. Specifically, the interfacing of the cam surfaces of the cam 164 and the collar 166 increases the axial spacing between the cam and the collar as the projection on the cam surface 174 contacts the cam surface 172 and moves the collar away from the cam. As the collar 166 moves away from the cam 164, the collar axially moves the transmission shaft 140 and the left lock plate 146 inwardly while pushing the cam 164 against the right lock plate 148 thereby moving the right lock plate toward the left lock plate. As the left and right lock plates 146 and 148 move toward each other, the "U"-shaped brackets 150 and 152 contact and apply pressure to the bottom ends 105 of the support columns 104 with sufficient force to cause the bottom ends of the support columns 104 to move inwardly and the top ends 107 of the support columns to move outwardly as shown by the arrows in FIG. 6B. The outward movement of the top ends of the support columns applies a clamping or holding force on the bores 112 of the carriage 110 that corresponds to the clamping force applied to the lower or bottom ends of the support columns to securely hold the carriage in position. Also, by mounting the carriage locking mechanism 132 below the middle support shelf 126 of the base 102 and skewing or angling the support columns 104 in this manner, the carriage locking mechanism 132 securely holds the carriage 110 in position, thereby providing more stability to the carriage 110 and reducing snipe and carriage vibration and movement.

To unlock the carriage 110, the handle 171 is rotated clockwise (i.e., upward) which causes the left lock plate 146 to move away from the right lock plate 148, thereby releasing the clamping force on the bottom ends 105 of the support columns 104 and freeing the support columns 104, the carriage 110 and the lead screws 120,122 to move with respect to the base.

Referring to FIG. 4, drive rollers 194 and 196 pull a workpiece into the thickness planer 100 and push the workpiece out of the thickness planer 100, respectively. Also in the illustrated embodiment, the depth of cut indicator 136 includes a depth display 198, a side mount 200 connected to the depth display, and a mounting plate 202 defining a hole for receiving an axle 204 which is inserted through the side mount 200 and the depth display 198 for rotation thereon. A spring 206 biases a pointer 208 to indicate the depth on the depth display 198. A washer 210 and a lock nut 212 secure the spring 206 in position and the side mount 200 is secured to the mounting plate 202 using a lock nut 214. The mounting plate 202 is secured to the carriage base 216 using fasteners 218. Although this configuration is shown, any type of moveable connection could be used. It should be appreciated that an English or Metric scale may be inscribed or painted on the surface of the depth display 198. In the illustrated embodiment, the depth indicator readings displayed by the depth display 198 are magnified so that small changes in depth move the pointer 208 a greater distance thereby making the depth display 198 easier to read.

As shown in FIG. 4, the carriage 110 and more specifically, the carriage base 216 includes a front cover 220 and a rear cover 222 that are connected together via fasteners to cover the front, top and rear portions of the carriage base 216 and other internal components. Two side covers 224 and 226 are attached to the respective sides of the carriage base 216 in a similar manner.

Similarly, the components located in the base 102 of the planer 100 are protected by side base covers 228 and 230, which are attached to the base support 186 using suitable fasteners. The side covers 228 and 230 are respectively positioned on and secured to a foot support 231 having a left side 232 and a right side 234.

Also as shown in FIG. 4, the inlet support shelf 124 is supported and secured to the base support 186 by attaching at least one shelf support bracket 236*a* to the inlet support shelf 124 using fasteners and attaching the shelf support bracket 236*a* to a support flange 238*a* on the support base 186. The outlet support shelf 128 is also attached to the base support 186 by securing a shelf support bracket 236*b* to the outlet support shelf 128 and then attaching the shelf support bracket 236*b* to a support flange 238*b* on the base support 186 using suitable fasteners. It is contemplated that one or more support brackets 236*a*, 236*b* may be used to secure the inlet and outlet support shelves 124 and 128 to the base 102.

The middle support shelf 126 is secured to the base support 186 by attaching two side rails 242 and 244 to the middle support shelf 126 and then securing the side rails to the base support 186 using suitable fasteners.

In operation, a workpiece is placed on inlet support shelf 124 attached to the base 102. The handwheel 130 is rotated in a clockwise or counterclockwise direction, which in turn, rotates the transmission shaft 140 and the transmission gears 161 in a clockwise or counterclockwise direction. As described above, the transmission gears 161 mesh with the corresponding lead gears 131 on the lead screws 120,122 to rotate the lead gears and the lead screws. Rotation of the lead screws 120,122 causes the lead screws to move upward or downward with respect to the base 102, which enables the carriage 110 to be moved to a designated distance above the workpiece based on the depth of the cut to be made on the workpiece.

To reduce movement and vibration of the carriage 110, the carriage is secured in position by the locking mechanism 132. Initially, the locking mechanism 132 is in an "unsecured" position where the "U"-shaped brackets 150 and 152 lightly contact or are separate from the support columns 104 as shown in FIG. 10A. In the "unsecured" position, the carriage 110 and the support columns 104 can be freely moved upward or downward with respect to the base 102 using lead screws 120, 122 and the handwheel 130.

To secure the carriage 110 in position, the handle 171 is rotated in a clockwise direction, which rotates the collar 166. As shown in FIG. 10B, the rotation of the collar 166 increases the axial spacing between the collar 166 and the cam 164 when the projection on the cam surface 174 of the collar pushes against the cam surface 172 of the cam. The interfacing of the cam surfaces 172,174 causes the transmission shaft 140 to move axially outward pulling the left lock plate 146. Also, the camming action causes the cam 164 to move inwardly against the right lock plate 148 thereby causing the "U"-shaped brackets 150,152 to contact the support columns 104 adjacent to those brackets. The "U"-shaped brackets 150 and 152 contact the corresponding support columns 104 with sufficient force to cause the bottom or lower ends 105 of the support columns to move inwardly and the top or upper ends 107 of the support columns to move outwardly as shown by the arrows in FIG. 6B. The outward movement of the top ends 107 of the support columns 104 exerts a clamping or holding force on the bores 112 of the carriage 110 corresponding to the clamping force generated by the left and right lock plates 146 and 148 on the bottom ends 105 of the support columns to firmly secure the carriage 110 in position.

To subsequently move or adjust the position of the carriage 110, the handle 171 is rotated in a counter-clockwise direction, which causes the collar 166 and the transmission shaft 140 to rotate in a counter-clockwise direction. During rotation, the collar 166 moves closer to the cam 164 (i.e., reducing the axial spacing between the collar and the cam) causing the transmission shaft 140 to move axially toward the left lock plate 146 thereby releasing the pressure or force of the "U"-shaped brackets 150 on the corresponding support columns 104. Similarly, the cam 164 moves closer to the collar 166, which causes the right lock plate 148 to move outwardly to release the force of the "U"-shaped brackets 152 on the corresponding support columns 104. Once released, the carriage 110, the support columns 104 and the lead screws 120,122 can be moved upward or downward with respect to the base 102.

Although various embodiments have been shown and described, the invention is not so limited and will be understood to include all such modifications and variations as would be apparent to one skilled in the art.

While a particular embodiment of the planer having a locking mechanism has been described herein, it will be appreciated by those skilled in the art that changes and modifications may be made thereto without departing from the invention in its broader aspects and as set forth in the following claims.

The invention claimed is:

1. A locking mechanism for use with a thickness planer having a base including a base support, and a carriage with a cutting head, the carriage being mounted to a plurality of support columns that are movably attached to the base to allow the carriage to be displaceable from the base at a defined distance, where a workpiece passes between a work area on the base and the cutting head on the carriage to remove a layer of the workpiece, the locking mechanism comprising:

a first lock plate associated with the base and positioned adjacent to a first pair of the support columns;

a second lock plate associated with the base and positioned adjacent to a second different pair of the support columns, said first and second lock plates being mounted on an underside of the base support; and an actuator coupled to said first lock plate and said second lock plate, wherein said actuator is configured for causing said first lock plate to engage said first pair of the support columns and said second lock plate to engage said second pair of the support columns to exert a clamping force by moving said first and second lock plates towards each other to firmly secure the carriage in position.

2. The locking mechanism of claim 1, further comprising "U"-shaped brackets attached to opposing ends of the first and second lock plates, each of said "U"-shaped brackets configured for directly engaging a designated pair of the support columns.

3. The locking mechanism of claim 1, wherein said actuator, includes a cam assembly configured so that said actuator is movable between a "release" position and a "locked" position by interface of opposing cam surfaces to apply a clamping force to at least one of said first lock plate and said second lock plate.

4. The locking mechanism of claim 3, wherein said cam assembly includes a cam non-rotatably attached to said second lock plate and having an associated cam surface.

5. The locking mechanism of claim 4, wherein said actuator includes a handle with a collar, said collar having a complimentary cam surface configured for engaging said cam to generate said clamping force exerted by said cam.

6. The locking mechanism of claim 5, wherein said handle includes a knob and an arm, said arm being attached at one end to said knob and at an opposing end to said collar.

7. The locking mechanism of claim 1, wherein the base support includes grooves for accommodating a corresponding one of said first and second lock plates so that said first and second lock plates are axially movable in said grooves.

8. A locking mechanism for use with a thickness planer having a base and a carriage with a cutting head, the carriage defining a plurality of bores where one of a plurality of support columns is mounted in each of the bores so that the carriage is displaceable from the base at a defined distance by movement of the support columns through the base, where a workpiece passes between a work area on the base and the cutting head on the carriage to remove a layer of the workpiece, the locking mechanism comprising:

a first lock plate positioned adjacent to the lower ends of a first pair of the support columns;

a second lock plate positioned adjacent to the lower ends of a second opposing pair of the support columns; and an actuator coupled to at least one of said first lock plate and said second lock plate, wherein actuation of said actuator causes said first lock plate and said second lock plate to respectively displace said first pair and said second pair of the support columns causing said first pair and said second pair of the support columns to exert a holding force on the bores defined by the carriage to securely hold the carriage in position, wherein each of said first pair and second pair of the support columns includes a top end and a bottom end, whereupon activation of said actuator causes said first and second lock plates to move towards each other and engage said bottom ends of said first pair and said second pair of the support columns causing said top ends of the support columns to exert said holding force on the bores defined by the carriage.

9. The locking mechanism of claim 8, further comprising "U"-shaped brackets attached to opposing ends of the first and second lock plates, each of said "U"-shaped brackets configured for directly engaging a designated pair of the support columns.

10. A thickness planer for reducing the thickness of a workpiece comprising:

a base including a base support, said base having a work area over which a workpiece travels;

a first pair of support columns movably connected to said base;

a second pair of support columns movably connected to said base, said second pair of support columns being on an opposite side of said base from said first pair of support columns, each of said first pair and said second pair of support columns including a top end and a bottom end;

a carriage having a cutting blade assembly, the carriage being mounted to said first pair of support columns and said second pair of support columns to enable said carriage to be raised a distance above said base, the cutting blade assembly configured for cutting the workpiece as it passes between the work area on the base and the carriage; and a carriage locking mechanism for securing said carriage in position, said carriage locking mechanism comprising:

a first lock plate mounted to said base and positioned adjacent to said first pair of support columns;

a second lock plate mounted to said base and positioned adjacent to said second pair of support columns, wherein said base support includes grooves for accommodating a corresponding one of said first and second lock plates so that said first and second lock plates are axially movable in said grooves; and an actuator coupled to said first lock plate and said second lock plate, said actuator including a cam assembly configured so that said actuator is movable between a "release" position and a "locked" position by interface of opposing cam surfaces causing said first lock plate and said second lock plate to exert a clamping force on said lower ends of said first pair and said second pair of support columns generating a corresponding clamping force on said upper ends of said first pair and said second pair of support columns for holding the carriage in position.

11. The thickness planer of claim 10, further comprising "U"-shaped brackets attached to opposing ends of the first and second lock plates, each of said "U"-shaped brackets configured for directly engaging said first pair and said second pair of support columns.

12. The thickness planer of claim 10, wherein said cam assembly includes a cam non-rotatably attached to said second lock plate and having an associated cam surface.

13. The thickness planer of claim 12, wherein said actuator includes a handle with a collar, said collar having a complimentary cam surface configured for engaging said cam to generate said clamping force exerted by said cam.

14. The thickness planer of claim 10, wherein said first and second lock plates are mounted on an underside of said base support.

15. A thickness planer for reducing the thickness of a workpiece comprising:

a base including a base support, said base having a work area over which a workpiece travels;

a first pair of support columns movably connected to said base;

a second pair of support columns movably connected to said base, said second pair of support columns being on an opposite side of said base from said first pair of support columns, each of said first pair and said second pair of support columns including a top end and a bottom end;

a carriage having a cutting blade assembly, the carriage being mounted to said first pair of support columns and said second pair of support columns to enable aid carriage to be raised a distance above said base, the cutting blade assembly configured for cutting the workpiece as it passes between the work area on the base and the carriage; and a carriage locking mechanism for securing said carriage in position, said carriage locking mechanism comprising:

a first lock plate mounted to said base and positioned adjacent to said first pair of support columns;

a second lock plate mounted to said base and positioned adjacent to said second pair of support columns, said first and second lock plates being mounted on an underside of said base support; and an actuator coupled to said first lock plate and said second lock plate, said actuator including a cam assembly configured so that said actuator is movable between a "release" position and a "locked" position by interface of opposing cam surfaces causing said first lock plate and said second lock plate to exert a clamping force on said lower ends of said first pair and said second pair of support columns generating a corresponding clamping force on said upper ends of said first pair and said second pair of support columns for holding the carriage in position.

* * * * *